United States Patent [19]

Cox

[11] Patent Number: 5,010,727

[45] Date of Patent: Apr. 30, 1991

[54] METHOD FOR EVALUATING THE WORKING LINE CHARACTERISTICS OF A COMPRESSOR OF A GAS TURBINE ENGINE

[75] Inventor: Michael J. Cox, Derby, England

[73] Assignee: Rolls-Royce PLC, London, England

[21] Appl. No.: 359,144

[22] Filed: May 31, 1989

Related U.S. Application Data

[62] Division of Ser. No. 150,238, Jan. 29, 1988, Pat. No. 4,856,274.

[30] Foreign Application Priority Data

Mar. 23, 1987 [GB] United Kingdom ..... 8706878

[51] Int. Cl.[5] ..... F02C 7/00

[52] U.S. Cl. ..... 60/39.06; 73/116

[58] Field of Search ..... 60/39.06, 39.33, 734, 60/740, 741, 39.281; 73/116

[56] References Cited

U.S. PATENT DOCUMENTS 2,552,231 5/1951 Streid et al. ..... 60/39.141
2,804,241 8/1957 McDowall et al. ..... 60/39.281
3,002,349 10/1961 Arnett et al. ..... 60/39.281
3,006,144 10/1961 Arnett et al. ..... 60/39.281

*Primary Examiner*—Louis J. Casaregola
*Attorney, Agent, or Firm*—Cushman, Darby & Cushman

[57] ABSTRACT

To evaluate the working line characteristics of a compressor of a gas turbine engine, fuel is supplied from the gas turbine engine fuel supply to a fuel accumulator via a control valve. The control valve is closed when a predetermined quantity of fuel is in the fuel accumulator, and a three way valve is adjusted to allow high pressure fluid from a fluid cylinder into the accumulator to pressurize the fuel. The fuel is then supplied from the accumulator via the valve to a combustion chamber to be burnt to increase the pressure in the combustion chamber and hence the compressor. The pressure of the fuel supplied which causes a surge is indicative of the working line characteristics of the compressor. The pressure and quantity of fuel supplied are varied until a surge is produced.

Reworking of compressors with reduced surge margin can be carried out. Enables evaluation to take place while the engine is fixed to an aircraft.

2 Claims, 4 Drawing Sheets

METHOD FOR EVALUATING THE WORKING LINE CHARACTERISTICS OF A COMPRESSOR OF A GAS TURBINE ENGINE

The present invention relates to a method and apparatus for evaluating the working line characteristics, health, of a gas turbine engine, and is particularly concerned with evaluating the working line characteristics of a compressor of a gas turbine engine.

It is often necessary to evaluate the working line characteristics, health, of a compressor of a gas turbine engine, this is generally carried out on engine test beds and necessitates the removal of the gas turbine engine from an associated aircraft, and the transportation of the gas turbine engine to and from an engine test bed. It is also necessary to have spare engines available which can be fitted to the aircraft whilst an engine is being tested.

The present invention seeks to provide a method and apparatus for evaluating the working line characteristics of a compressor of a gas turbine engine without the removal of the gas turbine engine from the associated aircraft.

Accordingly the present invention provides a method of evaluating the working line characteristics of a compressor of a gas turbine engine comprising the steps of supplying fuel to a fuel accumulator, pressurizing the fuel, supplying the fuel to a combustion chamber of the gas turbine engine to increase the pressure in the combustion chamber, and determining whether said pressure increase in said combustion chamber and hence said pressure of fuel in the fuel accumulator is sufficient to induce a surge in said compressor, the pressure of said fuel sufficient to induce any such surge being indicative of said working line characteristics of said compressor.

The fuel in the accumulator being pressurised by supplying high pressure fluid to the accumulator.

An apparatus for evaluating the working line characteristics of a compressor of a gas turbine engine comprises a fuel accumulator, a first valve means, a second valve means, a supply of fuel and a supply of high pressure fluid, the fuel supply being arranged to supply fuel through the first valve means to the fuel accumulator, the supply of high pressure fluid being arranged to supply fluid to the fuel accumulator through the second valve means to pressurise the fuel, the fuel accumulator being arranged to supply pressurised fuel through the first valve means to a combustion chamber of the gas turbine engine to increase the pressure in the combustion chamber.

The present invention will be more fully described by way of example with reference to the accompanying drawings, in which.

Figure 3:
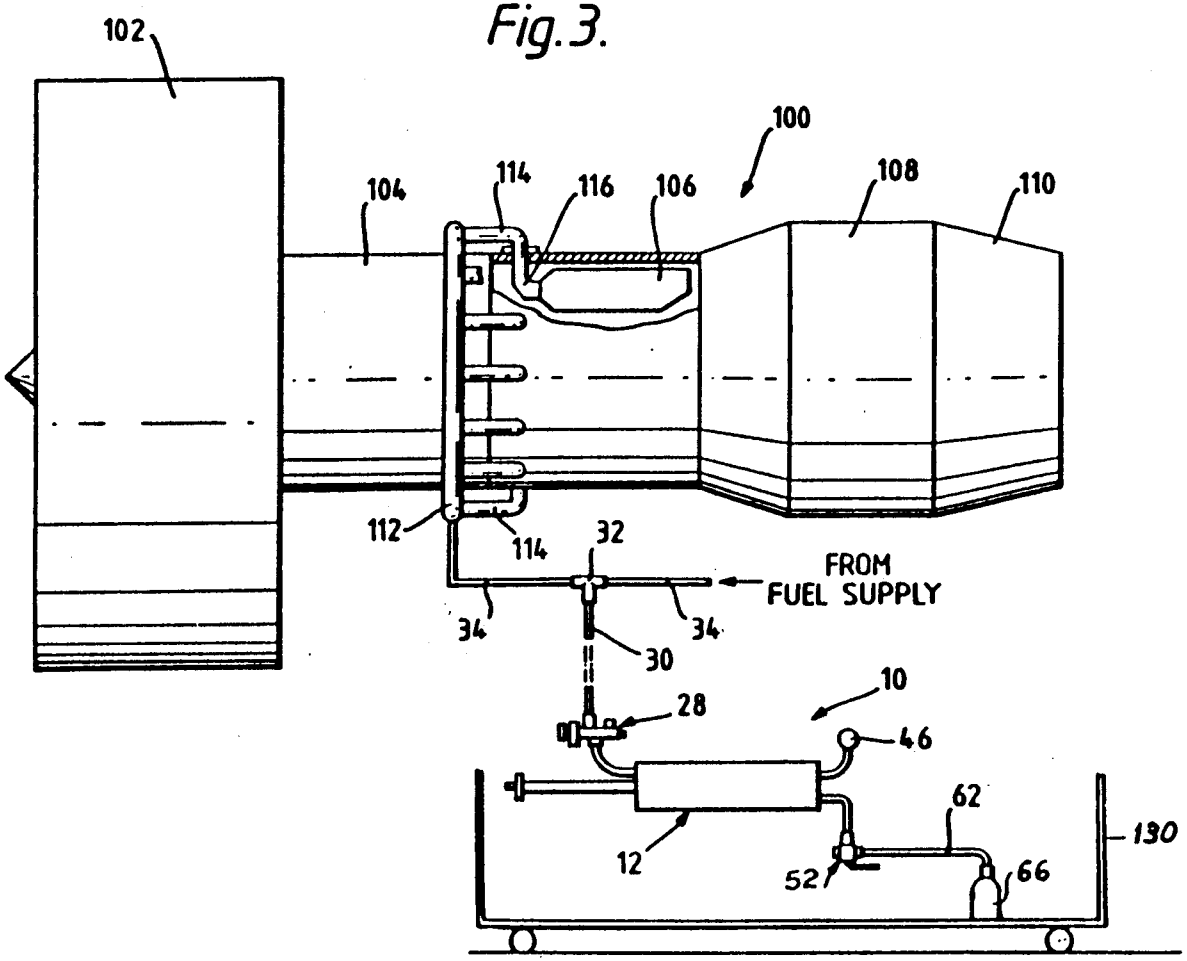
FIG. 3 shows the apparatus of FIG. 1 when applied to a gas turbine engine.

A turbofan gas turbine engine 100 is shown in FIG. 3 and comprises in axial flow series a fan and intermediate pressure compressor 102, a high pressure compressor 104, a combustion system 106, a turbine section 108 and an exhaust nozzle 110. The turbofan gas turbine engine 100 operates quite conventionally in that air is compressed by the fan and intermediate pressure compressor 102 and the high pressure compressor 104 before being supplied to the combustion system 106. Fuel is injected into the combustion system 106 and burnt in the compressed air to produce hot gases. The hot gases flow through and drive the turbine section 108 before flowing through the exhaust nozzle 110 to atmosphere. The turbine section 108 comprises a number of turbines which are drivingly connected to the fan, intermediate pressure compressor and high pressure compressor via shafts. The combustion system 106 comprises in this example an annular combustion chamber although a can-annular or other arrangement could be used. The combustion system is supplied with fuel from a plurality of circumferentially arranged fuel burners 116, each fuel burner 116 is supplied with fuel from a fuel manifold 112 via pipes 114. The fuel manifold 112 is supplied with fuel by a pipe 34 from a fuel supply via a fuel flow governor (not shown).

Figure 1:
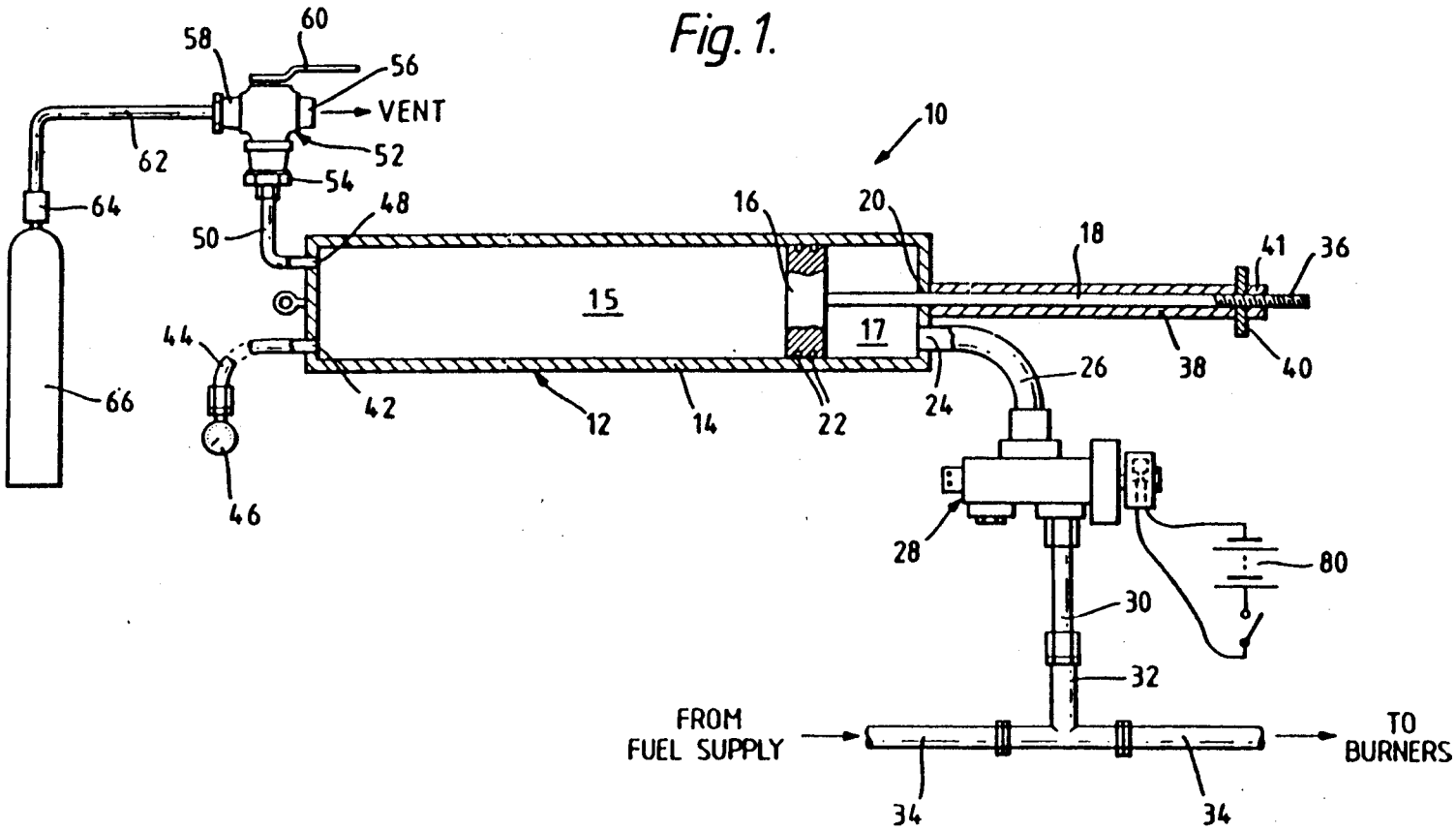
FIG. 1 shows an apparatus for evaluating the working line characteristics of a compressor of a gas turbine engine.
Figure 2:
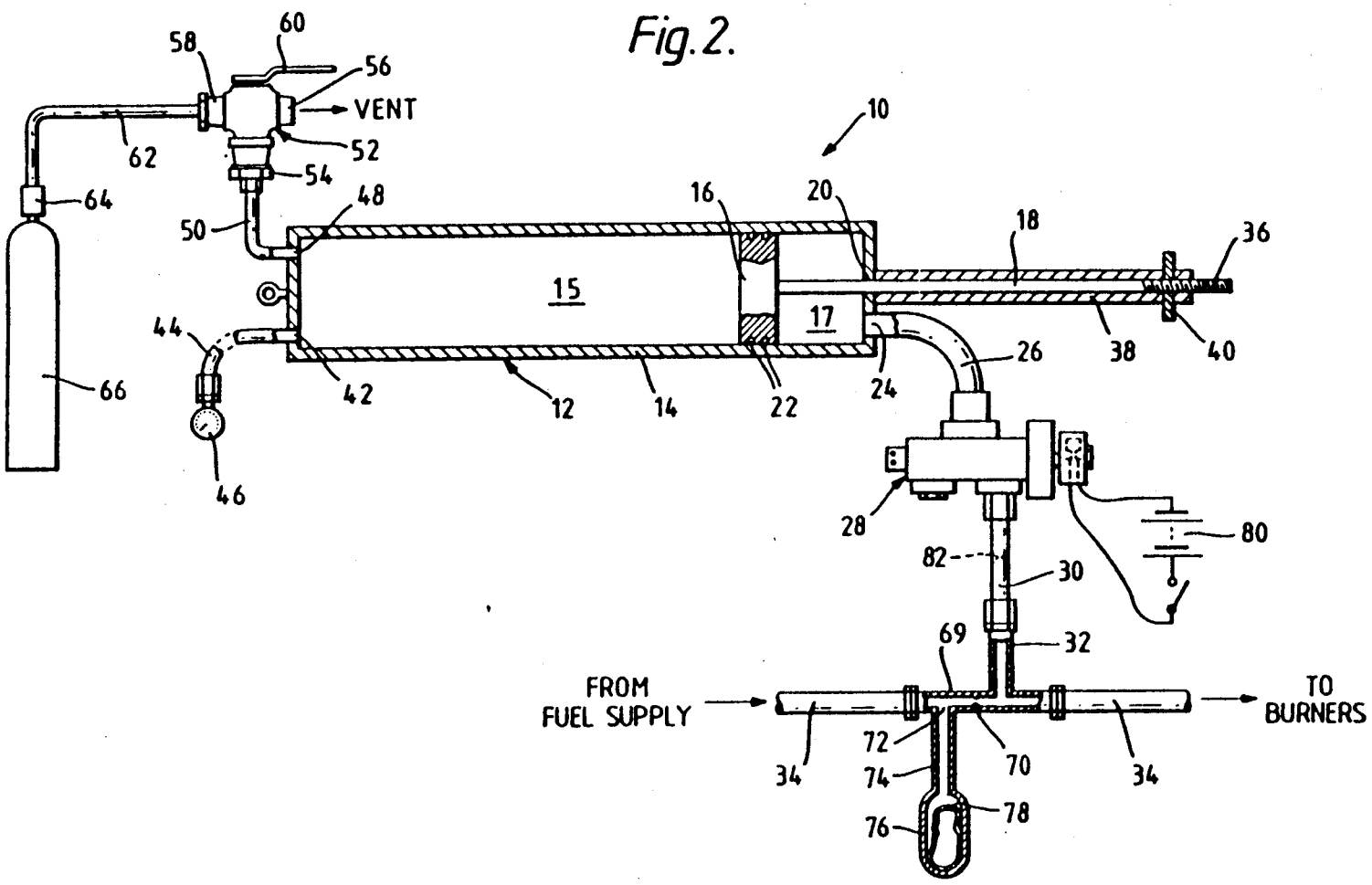
FIG. 2 shows a second embodiment of an apparatus for evaluating the working line characteristics of a compressor of a gas turbine engine.

An apparatus 10 for evaluating the working line characteristics, health, of the high pressure compressor 104 of the gas turbine engine 100 is also shown, but is shown more clearly in FIGS. 1 and 2. The apparatus 10 for evaluating the working line characteristics, health, of the high pressure compressor 104 as shown in FIG. 1 comprises a fuel accumulator 12, a control valve 28, a three way valve 52 and a supply of high pressure fluid 66.

The fuel accumulator 12 comprises a piston 16 contained within, and free to move axially within, a cylinder 14. The piston 16 defines with the cylinder two chambers 15 and 17 respectively. The piston 16 has a rod 18 which extends axially through the chamber 17 and through an aperture 20 in the cylinder 14. The rod 18 extends coaxially through a spacing tube 38, the free end 36 of the rod 18 is threaded and a washer 40 is positioned on the rod 18 and retained by a nut 41. The piston 16 also has a pair of seals 22 on its circumferential periphery which seal against the inner surface of the cylinder 14.

The cylinder 14 has an aperture 24 which connects the chamber 17 to the fuel supply and fuel burners via a pipe 26, the control valve 28, a pipe 30 and a T connector 32. The cylinder 14 has an aperture 42 which connects the chamber 15 to a pressure gauge 46 via a pipe 44, and an aperture 48 which connects the chamber 15 to the supply of high pressure fluid, cylinder, 66 via a pipe 50, the three way valve 52 and a pipe 62.

The control valve 28 is a high pressure quick acting valve and has a specification such that it will operate within a time period of the order of 0.1 second. The particular valve being used is pneumatically operated via a diaphragm and an electrically operated diverter valve or solenoid valve operating from a 28 volt DC supply 80 which conveniently may be the 28 volt DC supply of the aircraft.

The pipe 26 is a high pressure pipe and in this example a high pressure stainless steel pipe of 1¼ inches =3cm is used. The pipe 30 is several meters, in this example 5 m, in length and is 1 "=2.54 cm in diameter and is flexible.

The T connector 32 is removably fitted into the existing fuel system of the gas turbine engine, and is conveniently fitted in the place of a fuel flowmeter, however it can be fitted at any convenient point.

The pressure gauge 46 is suitable for use up to 3000 lbs sq in=21MN/m$^2$, and the pipe 44 in this example is ¼"=0.63 cm diameter. The pipes 50 and 62 are also ¼"=0.63 cm in diameter.

The three way valve 52 has three ports 54,56 and 58, and an operating mechanism. The port 54 is connected to the pipe 54, port 58 is connected to the pipe 62, and the port 56 is for venting to atmosphere. The three way valve 52 is also electrically operated by a 28 volt D.C. supply.

The supply of high pressure fluid is from the cylinder 66, which contains nitrogen at high pressure, but any other suitable pressurised gas or fluid could be used.

In operation to evaluate the working line characteristics, health or efficiency, of the compressor of the gas turbine engine, the T connector 32 is first removably connected into the fuel system of the gas turbine engine as mentioned above. The three way valve 52 is operated to allow a small pressure charge, of nitrogen, into the chamber 15 of the cylinder 14 from the cylinder 66. The gas turbine engine is then started and operated at flight idle conditions with the control valve 28 open to allow air to be bled from the fuel system. The three way valve 52 is then operated to connect the chamber 15 to atmosphere, the change in pressure difference across the piston 16, between the chambers 15 and 17, causes the piston to move axially in the cylinder 14 reducing the size of chamber 15 and allowing fuel from the gas turbine engine fuel system to flow into the chamber 17. When the chamber 17 is fully charged with fuel, i.e. when the washer 40 on the rod 36 abuts the spacing tube 38, the three way valve 52 is operated to cancel the venting of chamber 15 to atmosphere, and the control valve 28 is then closed. The three way valve 52 is then operated to connect the chamber 15 to the cylinder 66, and the chamber 15 is charged with nitrogen, or other suitable fluid, to the desired pressure and then the three way valve 52 is closed. The control valve 28 can then be opened at the desired time to supply the fuel in chamber 17 via the fuel manifold and fuel burners to the combustion chamber of the gas turbine engine.

Figure 4:
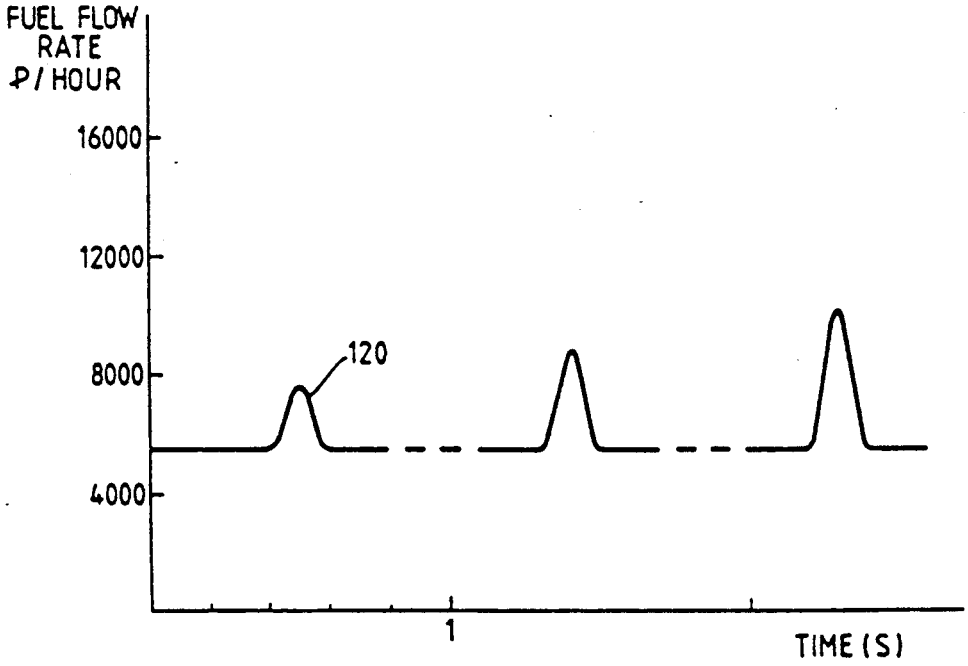
FIG. 4 is a graph of fuel flow rate to the combustion chamber of the gas turbine engine versus time.

Referring to FIG. 4 which shows a graph of fuel flow rate to the combustion chamber of the gas turbine engine against time, the rate of fuel flow to the combustion chamber at an engine operating condition where the integrated engine pressure ratio (IEPR) is 1.39, which is the maximum engine operating condition allowable for safety, for the RB211-535C turbofan, is of the order of 1277 gallons per hour (gph)=5440 liters per hour (lph) from the fuel flow governor. The integrated engine pressure ratio is the ratio of the pressure at the core engine exhaust and fan discharge pressure compared to the intake pressure to the gas turbine engine. In some gas turbine engines the engine pressure ratio (EPR) is used, which is the core engine exhaust pressure compared to the intake pressure to the gas turbine engine. The introduction of the fuel from the fuel accumulator produces a fuel spike 120.

If a fuel spike with a sufficiently high peak fuel flow rate can be introduced into the fuel system of the gas turbine engine, this will cause the pressure to increase in the combustion chamber of the gas turbine engine, this in turn causes the downstream high pressure end of the high pressure compressor to go into a stall and eventually a surge condition.

If the high pressure compressor is not healthy, the compressor is not efficient, i.e. if the working line characteristics of the high pressure compressor have changed to reduce the surge margin, only a relatively low peak fuel flow rate will be required to make the high pressure compressor surge, however if the high pressure compressor is healthy, if the working line characteristics of the high pressure compressor and the surge margins are substantially as designed, a relatively high peak fuel flow rate will be required to make the high pressure compressor surge.

The deterioration of the compressor health, efficiency, may be due to an increase in the various working clearances i.e. the blade tip clearances due to the gradual erosion of the compressor casing abradable linings, or may be due to other factors such as ingestion of foreign bodies.

The apparatus for evaluating the working line characteristics of the high pressure compressor is used to introduce fuel spikes into the combustion chamber of the gas turbine engine. Initially a relatively small peak fuel flow rate spike is used, if this does not produce surge the peak fuel flow rate of further spikes is progressively increased until a surge is produced in the compressor. The height of the fuel spike required to produce the surge gives a measure of the working line characteristics of the compressor.

The height of the fuel spike above the steady 5440 lph rate is proportional to the pressure of the nitrogen in the chamber 15, and the width of the fuel spike, the dwell time, at its peak is dependent upon the amount of fuel in chamber 17 i.e. the volume of chamber 17. The fuel spike height can be preselected by choosing a predetermined pressure in the chamber 15, and the dwell time of the fuel spike can be preselected by choosing a predetermined volume of fuel in chamber 15. The volume of chamber 15 is controlled by the spacing tube 38 which limits the axial movement of the piston 16 within the cylinder 14. The volume of chamber 15 can be changed by positioning metal shims between the spacing tube 38 and washer 40 or by using spacing tubes 38 with different lengths.

The fuel spikes being used for the RB211-535C turbofan have peak flow rates of 1780 gph=7570 lph, 2077 gph=8848 lph and 2377 gph=10,120 lph and are shown on FIG. 4.

Initially a fuel spike of peak flow rate 7570 lph is injected into the combustion chamber, if the compressor surges the gas turbine engine is removed for reworking. If the compressor does not surge a fuel spike of 8848 lph peak flow rate is injected into the combustion chamber, if the compressor surges the gas turbine engine is given a first limited cycle life before it has to be tested again. If the compressor does not surge a fuel spike of 10,120 lph peak flow rate is injected into the combustion chamber, if the compressor surges the gas turbine engine is again given a second limited cycle life before it has to be tested again, the second limited cycle life being greater than the first. If the compressor does not surge it is cleared with no restriction on cycle life.

The working line characteristics of the compressor for the RB211-535C may also be evaluated using two fuel spikes of 1977 lph and 2277 lph. If the compressor surges with the first fuel spike of 1977 lph it is removed for reworking, if it surges with the second fuel spike of 2277 lph it is given a limited cycle life before it has to be tested again. If it does not surge it is cleared with no restriction on cycle life.

The cycle life restriction could be of the order of 200 cycles i.e. 200 flights.

It is quite clear that any number of fuel spikes could be used to test the compressors of engines, so as to grade them according to their working line characteristics, health, efficiency.

However, the method and apparatus is applicable to all types of gas turbine engines, but the particular engine operating condition fuel flow rates and fuel spikes peak flow rates will vary for different engine types.

The embodiment in FIG. 2 is essentially the same as that shown in FIG. 1 and like parts are denoted by like numerals. The T connector 32 however differs in that a restrictor 70 is fitted in the pipe 69 connecting to the fuel supply to reduce the pressure pulse during the fuel spike. The pipe 69 also has an aperture 72 which connects to a cylinder 76 via a flexible pipe 74. A bag accumulator 78 is positioned within the cylinder 76, and the bag accumulator is charged to a predetermined pressure, in this example of 500 lbs per sq inch=3.45 $MN/m^2$, to remove a low pressure pulse in the fuel flow governor at the steady fuel flow rate. A restrictor 82 is fitted into the pipe 30 to alter the rate of the fuel spike.

The apparatus can be fitted onto a portable trolley as indicated schematically by the numeral 130 in FIG. 3 which can be easily moved to a gas turbine engine to be tested. This allows the gas turbine engine to remain located fixed to an associated aircraft while the working line characteristics of the compressor of the gas turbine engine are evaluated. It may then be necessary to remove the gas turbine engine for reworking or repairs, if the working line characteristics are not satisfactory. However, only those gas turbine engines requiring reworking or repair are removed, not satisfactory engines.

The above method of operation may be carried out by a remote control system.

The above method allows the working line characteristics of the compressor of the gas turbine engine to be evaluated much quicker than at present.

I claim:

1. A method of evaluating the working line characteristics of a compressor of a gas turbine engine comprising the steps of:

supplying fuel from the engine's normal fuel tank to a fuel accumulator, the fuel accumulator being connected to the engine during the evaluation;

pressurizing the fuel in the fuel accumulator;

measuring the pressure of the fuel in the accumulator;

supplying the fuel in the accumulator to a combustion chamber of the gas turbine engine to increase the pressure in the combustion chamber; and determining whether said measured pressure of fuel in the fuel accumulator results in a pressure increase in said combustion chamber sufficient to induce a surge in said compressor, wherein the pressure of the pressurized fuel in the fuel accumulator sufficient to induce any such surge is indicative of said working line characteristics of said compressor.

2. A method of evaluating the working line characteristics of a compressor of a gas turbine engine as claimed in claim 1 in which the fuel in the accumulator is pressurized by supplying high pressure fluid to the accumulator.

* * * * *